US006165011A

United States Patent [19]

Fukuda

[11] Patent Number: 6,165,011

[45] Date of Patent: Dec. 26, 2000

[54] DOUBLE-RETAINING CONNECTOR

[75] Inventor: Masaru Fukuda, Shizuoka, Japan

[73] Assignee: Yazaki Corporation, Tokyo, Japan

[21] Appl. No.: 09/233,959

[22] Filed: Jan. 20, 1999

[30] Foreign Application Priority Data

Jan. 21, 1998 [JP] Japan ..... 10-009539

[51] Int. Cl.[7] ..... H01R 13/40

[52] U.S. Cl. ..... 439/595

[58] Field of Search ..... 439/595, 752, 439/701

[56] References Cited

U.S. PATENT DOCUMENTS

| | | | |
|---|---|---|---|
| 5,954,546 | 9/1999 | Fink et al. | 439/752 |
| 5,997,352 | 12/1999 | Newport et al. | 439/595 |
| 6,010,364 | 1/2000 | Boyd et al. | 439/595 |

FOREIGN PATENT DOCUMENTS 7-282884 10/1995 Japan .

*Primary Examiner*—Khiem Nguyen

*Attorney, Agent, or Firm*—Sughrue, Mion, Zinn, Macpeak & Seas, PLLC

[57] ABSTRACT

A double-retaining connector includes a connector housing having an elastic terminal-retaining lance 6', and a spacer 3' which is inserted into the connector housing to prevent the terminal retaining lance from being flexed, and abuts against the terminal retaining lance when a terminal is half inserted, thereby detecting the half-inserted condition of the terminal. A jig rod insertion groove 5' for canceling the locking of the terminal retaining lance is formed in the spacer 3'. The jig rod insertion groove 5' is offset with respect to the center of the terminal retaining lance 6' in a direction of a width of the lance. A gap between one side surface **6*b*, of the terminal retaining lance 6' and a side surface of the spacer 3' or a side surface of the connector housing, which is opposed to the one side surface 6*b'*, is increased, so that a width of the jig insertion groove 5'** is increased.

5 Claims, 3 Drawing Sheets

DOUBLE-RETAINING CONNECTOR

BACKGROUND OF THE INVENTION

1. Field of the Invention

This invention relates to a double-retaining connector in which a half-inserted condition of a terminal can be positively detected through a spacer, and also the locking of a terminal retaining lance can be positively canceled by a jig rod.

2. Related Art

FIG. 5 is a conventional double-retaining connector disclosed in Japanese Patent Unexamined Publication No. 7-282884.

The double-retaining connector 25 comprises a connector housing 26, female terminals 27 inserted into the connector housing 26 from a rear side thereof, and a retaining spacer 28 inserted into the connector housing 26 from a front side thereof.

The terminal 27 is retained by a projected portion 30 of an elastic terminal-retaining lance 29 (formed within the connector housing 26) engaged with an edge portion 31 of a hole in the terminal, and the spacer 28 is inserted into a flexure space 32 for the terminal retaining lance 29, thereby preventing the terminal retaining lance 29 from being accidentally flexed. As shown in FIG. 6, the spacer 28 has a provisionally-retaining projection 33 and a completely-retaining projection 34 (for engagement with the connector housing 26 (FIG. 5)) formed respectively at opposite side portions thereof. The spacer 28 also has a jig rod insertion groove 36 formed in a central portion thereof, and a lock-canceling jig rod 35 (FIG. 5), such as a slotted screwdriver, can be inserted into this groove 36.

In a provisionally-retained condition in which the spacer 28 is withdrawn in a direction of arrow b (FIG. 5), the jig rod 35 is inserted into the connector housing 26 through the jig rod insertion groove 36, and the terminal retaining lance 29 is flexed or elastically deformed by the jig rod 35, thereby canceling the locking of the terminal, and then the terminal 27 is withdrawn.

The insertion of the terminal 27 is effected in the provisionally-retained condition of the spacer 28. If the insertion of the terminal 27 is incomplete, the terminal retaining lance 29 remains flexed, and in this case, when the spacer 28 is inserted into the connector housing, a distal end 37 of the spacer 28 abuts against the distal end of the terminal retaining lance 29, so that the spacer 28 fails to be completely retained, and therefore the incomplete insertion of the terminal is detected.

In the above conventional construction, however, the spacer 28 has reduced rigidity since the jig rod insertion groove 36 is formed in the spacer 28 as shown in FIG. 6, and particularly where the jig rod 35 to be used has a larger width so that the cancellation of the locking can be effected positively, the jig rod insertion groove 36 also has a larger width, and the rigidity of the spacer 28 is further reduced. Therefore, in the terminal half-inserted condition (incompletely-inserted condition), even if the spacer 28 interferes with the terminal retaining lance 29, the spacer 28 can be forced into the connector housing, which results in a possibility that the half-inserted condition of the terminal can not be detected.

SUMMARY OF THE INVENTION

With the above problem in view, it is an object of this invention to provide a double-retaining connector in which the locking of a terminal retaining lance can be positively canceled by a wide jig rod, and also a half-inserted condition of a terminal can be positively detected.

The above object has been achieved by a double-retaining connector of the present invention comprising a connector housing having an elastic terminal-retaining lance, and a spacer which is inserted into the connector housing to prevent the terminal retaining lance from being flexed, and abuts against the terminal retaining lance when a terminal is half inserted, thereby detecting the half-inserted condition of the terminal, wherein a jig rod insertion groove for canceling the locking of the terminal retaining lance is formed in the spacer; CHARACTERIZED in that the jig rod insertion groove is offset with respect to the center of the terminal retaining lance in a direction of a width of the lance.

Preferably, a gap between one side surface of the terminal retaining lance and a side surface of the spacer or a side surface of the connector housing, which is opposed to the one side surface, is increased, so that a width of the jig insertion groove is increased.

In the present invention, the jig rod insertion groove is offset with respect to the terminal retaining lance, and with this construction, the area of abutment of the spacer against the terminal retaining lance is increased, and the spacer can positively abut against the terminal retaining lance with a sufficient force in the half-inserted condition of the terminal, so that the half-inserted condition of the terminal can be positively detected. In the present invention, since the width of the jig rod insertion groove is increased, the locking of the terminal retaining lance can be positively canceled, using the wide jig rod.

BRIEF DESCRIPTION OF PREFERRED EMBODIMENTS

DETAILED DESCRIPTION OF THE PREFERRED EMBODIMENTS

A preferred embodiment of the present invention will now be described in detail with reference to the drawings.

Figure 1:
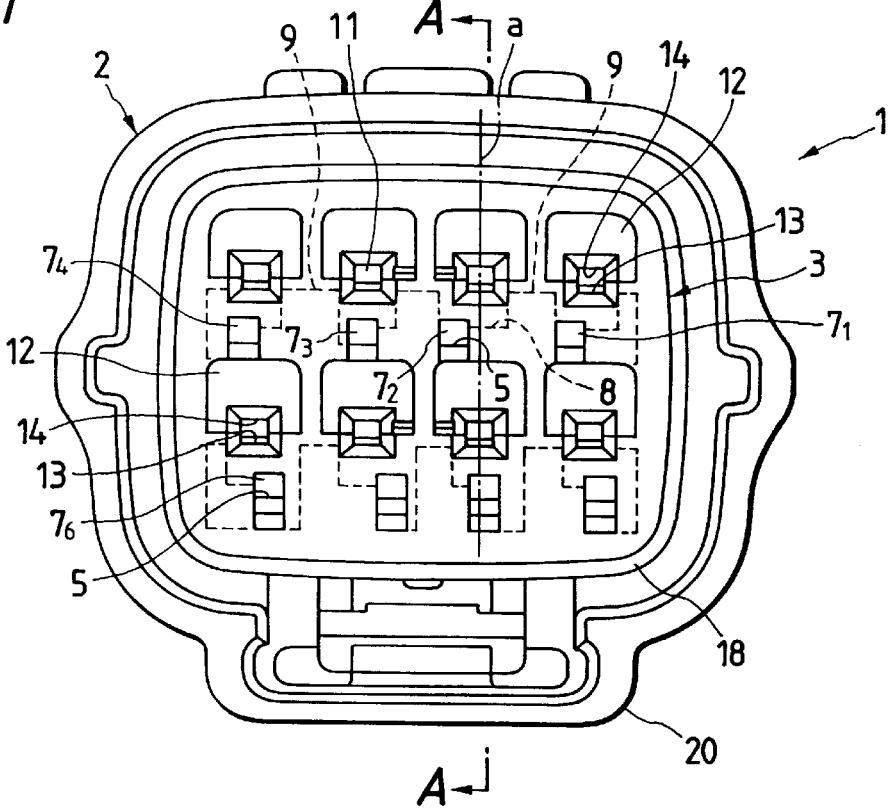
FIG. 1 is a front-elevational view of one preferred embodiment of a double-retaining connector of the present invention.
Figure 2:
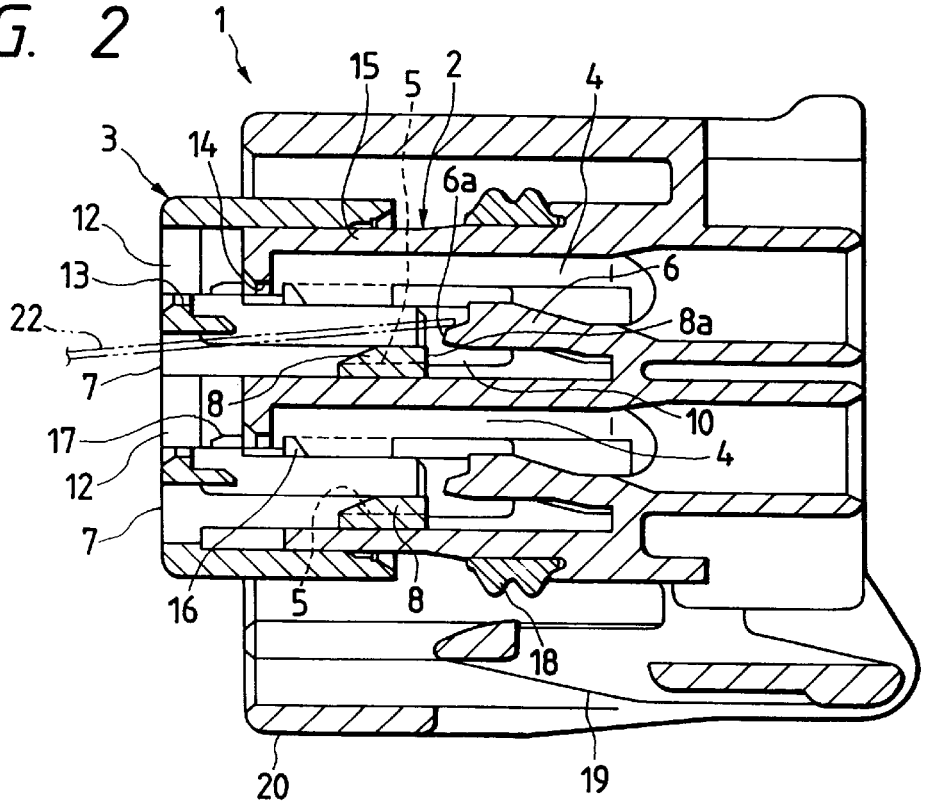
FIG. 2 is a cross-sectional view taken along the line A—A of FIG. 1.

FIGS. 1 and 2 show one preferred embodiment of a double-retaining connector of the present invention.

Like the conventional connector, this double-retaining connector 1 comprises a connector housing 2, made of a synthetic resin, female terminals (not shown) inserted into the connector housing 2 from a rear side thereof, and a spacer 3 of a synthetic resin inserted into the connector housing 2 from a front side thereof. Jig rod insertion grooves 5 are formed in the spacer 3, and communicate respectively with terminal receiving chambers 4 (FIG. 2) in the connector housing 2, and this invention has a feature that these grooves 5 are offset with respect to elastic terminal-retaining lances 6, respectively.

In this embodiment, the terminal receiving chambers 4 (FIG. 2) are arranged in two (upper and lower) rows, and openings (jig rod insertion holes) 7 (designated at $7_1$ to $7_5$ in FIG. 1), communicating respectively with the jig rod insertion grooves (jig rod guide grooves) 5, are formed respectively at the lower sides of the terminal receiving chambers 4. In FIG. 1, in each of the openings (jig rod insertion holes) $7_1$ to $7_5$, the jig rod insertion groove 5 (formed in a lance flexure prevention portion 8 (FIG. 2)) at a distal end of the spacer 3 is seen.

As shown in broken lines in FIG. 1, the spacer 3 includes a plurality of convex walls 9, projecting in an inserting direction, and recessed walls (i.e., lance flexure prevention portions 8 each in the form of a thin plate) each extending between the adjacent convex walls 9 and 9, and the jig rod insertion groove 5 is formed in the lance flexure prevention portion 8. In FIG. 2, each lance flexure prevention portion 8 can enter a corresponding flexure space 10 for the terminal retaining lance 6, and a distal end (abutment surface) 8*a* of the lance flexure prevention portion 8 can abut against a distal end 6*a* of the terminal retaining lance 6 flexed (or elastically deformed) in a half-inserted condition of the terminal.

As shown in FIG. 1, the jig rod insertion holes (openings) $7_3$ an $7_4$ (and hence the jig rod insertion grooves 5) are slightly offset respectively with respect to centers a (centerlines extending vertically in FIG. 1) of the corresponding terminal retaining lances 6 (and hence centerlines of male tab insertion holes 11 of the terminal receiving chambers 4) in overlapping relation thereto, and the insertion hole $7_5$ is offset to a centerline a of the corresponding lance 6, and the insertion holes $7_1$ and $7_2$ are much offset respectively beyond centerlines of the corresponding lances 6. In the embodiment shown in FIG. 1, the lower row of openings 7 are disposed substantially symmetrically (rotation symmetry) with respect to the upper row of openings 7.

The upper row of openings $7_1$ to $7_4$ communicate respectively with a lower row of housing engagement holes 12 in the spacer 3. A male tab insertion groove 13 of a U-shape (half-split shape) is formed at the open side of each of the upper and lower rows of housing engagement holes 12, and similarly male tab insertion grooves 14 of a U-shape are formed in the connector housing 2. When the spacer is completely inserted into the connector housing, each male tab insertion groove 13 and the associated male tab insertion groove 14 jointly form the male tab insertion hole 11. Male tabs are mounted in a mating female connector (not shown). As shown in FIG. 2, peripheral walls 15 of the terminal receiving chambers 4 in the connector housing 2 are inserted respectively into the housing engagement holes 12.

In FIG. 2, the spacer 3 is provisionally retained relative to the connector housing 2 through projections 16, and is completely retained relative to the connector housing through projections 17. In the completely-retained condition, the spacer 3 is fully pushed into the connector housing. Reference numeral 18 denotes a waterproof packing, reference numeral 19 a lock arm for the mating female connector, and reference numeral 20 a hood portion of the connector housing 2.

Figure 3:
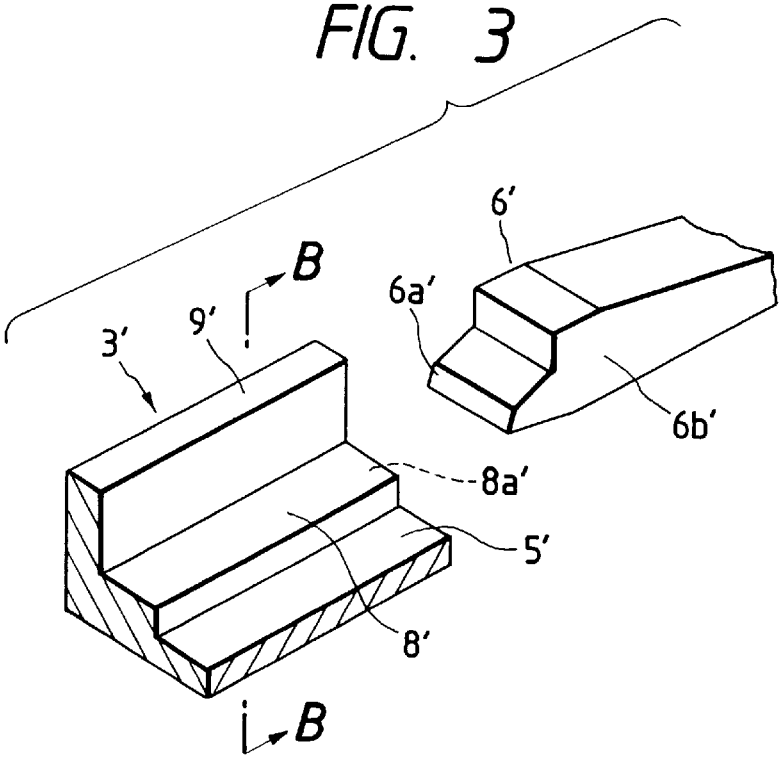
FIG. 3 is an exploded, perspectiveview, showing one example of a spacer for a terminal retaining lance.
Figure 4:
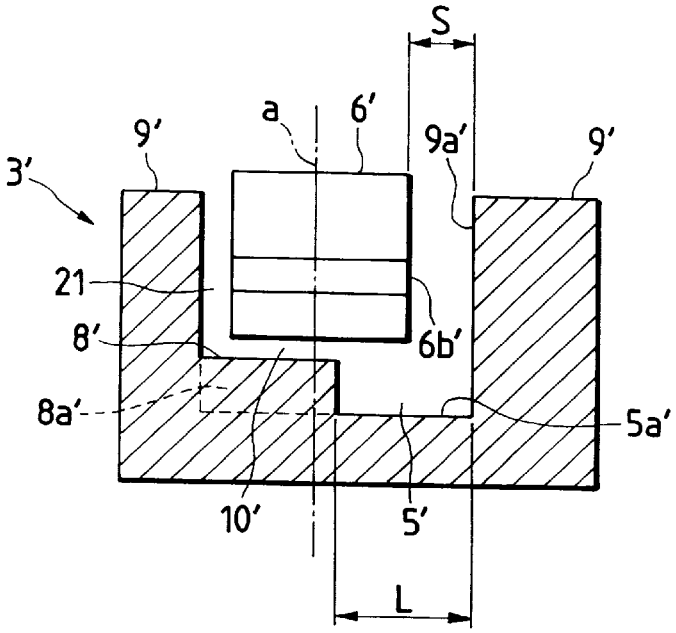
FIG. 4 is a cross-sectional view taken along the line B—B of FIG. 3.
Figure 5:
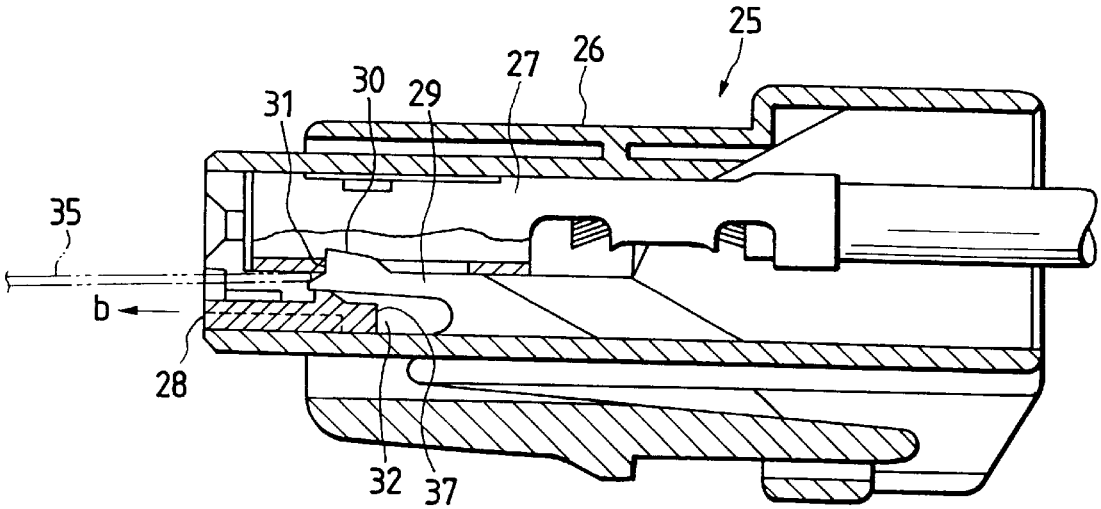
FIG. 5 PRIOR ART
FIG. 5 is a vertical cross-sectional view of a conventional double-retaining connector.
Figure 6:
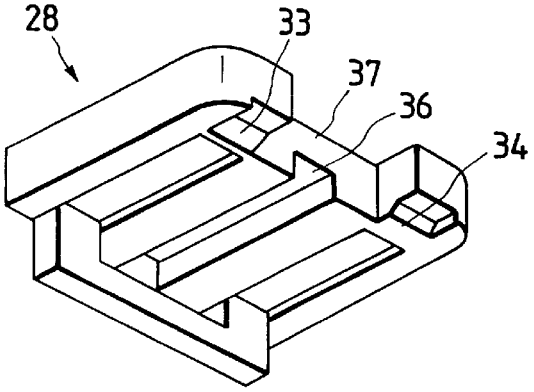
FIG. 6 PRIOR ART
FIG. 6 is a perspective view of a spacer of the conventional connector.

FIGS. 3 and 4 show one example of a spacer for the terminal retaining lance, and in this embodiment, a lance flexure prevention portion 8' is longer in an inserting direction as compared with the construction of FIGS. 1 and 2.

An abutment surface 8*a*' is formed at a distal end of the lance flexure prevention portion (base wall) 8' in a recess 21 of the spacer 3', and a jig rod insertion groove 5' is notched or formed in the base wall 8', and a bottom surface 5*a*' of the jig rod insertion groove 5' is disposed at a level lower by a step than the base wall 8'. A terminal retaining lance 6' hardly abuts against that portion of the lance flexure prevention portion disposed lower than the bottom surface 5*a*' of the jig rod insertion groove 5', but the depth of the jig rod insertion groove 5 can be so determined that the terminal retaining lance 6' can abut against that portion of the lance flexure prevention portion disposed lower than the lower surface 5*a'*.

The base wall 8' enters a flexure space 10' disposed at the lower side of the terminal retaining lance 6' in a free condition (that is, retainingly engaged with the terminal (not shown)), and the distal end (abutment surface) 8*a* of the base wall 8' abuts against a distal end 6*a*' of the terminal retaining lance 6' flexed in a half-inserted condition of the terminal (not shown). The terminal retaining lance 6' in its free condition is disposed between adjacent convex walls 9' and 9' (that is, in the recess 21).

The abutment surface 8*a*' of the spacer 3' extends slightly beyond a vertical centerline a (FIG. 4) of the terminal retaining lance 6', and has a sufficient area of abutment against the terminal retaining lance 6'. The jig rod insertion groove 5' is provided at that portion of the recess 21, disposed at a level below the terminal retaining lance 6', in adjacent relation to the abutment surface 8'. A gap (distance) S between a side surface 9*a*' of one of the opposed convex walls 9' and one side surface 6*b*' of the terminal retaining lance 6' is suitably increased, and by doing so, a width L of the jig rod insertion rod groove 5' can be increased in accordance with a width of a wide jig rod 22 (FIG. 2). The side surface, opposed to the side surface 6b' of the terminal retaining lance 6', is not limited to the side surface 9*a*', but may be an inner surface (not shown) of a side wall of the connector housing 2.

In each of the above embodiments, the wide abutment surface 8*a*, 8*a*' of the spacer 3, 3' can positively abut against the terminal retaining lance 6, 6', so that the half-inserted condition of the terminal can be detected. And besides, the locking of the terminal retaining lance 6, 6' can be positively canceled by the wide jig rod 22. The locking is canceled in the provisionally-retained condition in which the spacer 3 is projected from the connector housing, as shown in FIG. 2.

In the present invention, the jig rod insertion groove is offset with respect to the terminal retaining lance, and with this construction, the area of abutment of the spacer against the terminal retaining lance is increased, and the spacer can positively abut against the terminal retaining lance with a sufficient force in the half-inserted condition of the terminal, so that the half-inserted condition of the terminal can be positively detected. In the present invention, since the width of the jig rod insertion groove is increased, the locking of the terminal retaining lance can be positively canceled, using the wide jig rod.

What is claimed is:

1. A double-retaining connector comprising:

a connector housing having an elastic terminal-retaining lance;

a spacer inserted into said connector housing to prevent said terminal retaining lance from being flexed, and said spacer abutting against said terminal retaining lance when a terminal is half inserted, thereby detecting the half-inserted condition of said terminal; and a jig rod insertion groove formed in said spacer, said jig rod insertion groove being offset from a center of said terminal retaining lance in a direction of a width of said lance.

2. A double-retaining connector according to claim 1, in which a gap formed to a preselected width is defined by a first side surface of said terminal retaining lance and a second side surface of said spacer or said connector housing, wherein the first and second side surfaces are opposed to each other.

3. A double-retaining connector comprising:

a connector housing having an elastic terminal-retaining lance;

a spacer inserted into said connector housing to prevent said terminal retaining lance from being flexed, said spacer abutting against said terminal retaining lance when a terminal is half inserted, thereby detecting the half-inserted condition of said terminal;

a jig rod insertion groove formed in said spacer, said jig rod insertion groove being offset from a center of said terminal retaining lance in a direction of a width of said lance; and a gap defined between a first side surface of said terminal retaining lance and a second side surface of said spacer or said connector housing, wherein the first and second side surfaces are opposed to each other, said gap being formed to a predetermnined width.

4. A double-retaining connector comprising:

a connector housing having an elastic terminal-retaining lance;

a spacer having vertical walls disposed opposite to vertical side surfaces of said lance and having an abutment surface between said vertical walls, said spacer being inserted into said connector housing to prevent said terminal retaining lance from being flexed, and said spacer abutting against said terminal retaining lance when a terminal is half inserted, thereby detecting the half-inserted condition of said terminal; and a jig rod insertion groove formed in said spacer, said jig rod insertion groove being offset from a center of said terminal retaining lance in a direction of a width of said lance.

5. A double-retaining connector according to claim 4, in which a gap formed to a preselected width is defined by a first side surface of said terminal retaining lance and a second side surface of said spacer or said connector housing, wherein the first and second side surfaces are opposed to each other.

* * * * *